US005832634A

United States Patent [19]

Wong

[11] Patent Number: 5,832,634

[45] Date of Patent: Nov. 10, 1998

[54] SPORTS FOOTWEAR WITH A SOLE UNIT COMPRISING AT LEAST ONE COMPOSITE MATERIAL LAYER PARTLY INVOLVING THE SOLE UNIT ITSELF

[75] Inventor: King C. Wong, Kowloon, Hong Kong

[73] Assignee: Fila Sport S.p.A., Vicenza, Italy

[21] Appl. No.: 711,659

[22] Filed: Sep. 9, 1996

[30] Foreign Application Priority Data

Dec. 4, 1995 [IT] Italy ..... MI95A2540

[51] Int. Cl.[6] ..... A43B 23/00; A43B 13/14

[52] U.S. Cl. ..... 36/107; 36/108; 36/30 R; 36/31; 36/91

[58] Field of Search ..... 36/107, 108, 25 R, 36/30 R, 30 A, 31, 88, 91

[56] References Cited

U.S. PATENT DOCUMENTS

| | | | |
|---|---|---|---|
| 4,651,445 | 3/1987 | Hannibal . | |
| 4,694,591 | 9/1987 | Banich et al. | 36/30 R |
| 4,783,910 | 11/1988 | Boys, II et al. | 36/107 |
| 4,794,707 | 1/1989 | Franklin et al. | 36/107 |
| 4,890,397 | 1/1990 | Harada et al. | 36/30 R |
| 5,052,130 | 10/1991 | Barry et al. | 36/30 R |
| 5,092,060 | 3/1992 | Frachey et al. . | |
| 5,369,896 | 12/1994 | Frachey et al. . | |
| 5,401,564 | 3/1995 | Lee et al. | 36/30 R |

FOREIGN PATENT DOCUMENTS

| | | |
|---|---|---|
| 0 272 082 | 6/1988 | European Pat. Off. . |
| 0 471 447 | 2/1992 | European Pat. Off. . |
| 0 619 084 A1 | 10/1994 | European Pat. Off. . |
| 1 808 245 | 2/1960 | Germany . |
| 42 14 802 | 11/1993 | Germany . |
| 2 189 978 | 11/1987 | United Kingdom . |
| WO 91 01659 | 2/1991 | WIPO . |
| WO 91 09547 | 7/1991 | WIPO . |
| WO 94 13164 | 6/1994 | WIPO . |
| WO 94/21454 | 9/1994 | WIPO . |

OTHER PUBLICATIONS

Patent Abstract of Japan, vol. 16, No. 183, (C–0936), May 6, 1992, & Database WPI Derwent Publications, AN 92–077343, JP 04 024 011, Jan. 28, 1992.

*Primary Examiner*—M. D. Patterson

*Attorney, Agent, or Firm*—Oblon, Spivak, McClelland, Maier & Neustadt, P.C.

[57] ABSTRACT

Footwear, in particular sports footwear, which includes a vamp associated with a substantially flat foot-supporting lower part or sole unit. This latter comprises at least one portion formed of woven composite material having a part positioned in correspondence with the metatarsal region of the user's foot and a part positioned corresponding with the arch region of the user's foot, wherein the part of the portion present in the metatarsal region is flexible and enables the sole unit to flex during the use of the footwear and wherein part of the portion present in the plantar arch region is rigid.

21 Claims, 2 Drawing Sheets

SPORTS FOOTWEAR WITH A SOLE UNIT COMPRISING AT LEAST ONE COMPOSITE MATERIAL LAYER PARTLY INVOLVING THE SOLE UNIT ITSELF

BACKGROUND OF THE INVENTION

1. Field of the Invention

This invention relates to footwear, in particular sports footwear.

2. Discussion of the Background

The characteristics of sports footwear vary considerably. In particular, over the years it has been sought to design sports footwear or shoes which restore to the user part of the energy which he directs towards the ground or resting surface during walking, running, jumping or other movements. A large number of designs tending to achieve this object are therefore known. They generally comprise elastic inserts arranged within the sole unit preferably at the heel. Although these known designs achieve satisfactory results, they have various drawbacks. These include: excessive footwear weight leading to obvious problems of premature tiredness for the user (for example an athlete) during use; considerable constructional complexity leading to imperfect mounting of the sole unit and/or of the insert positioned in it with consequent imperfect energy return to the user's foot; a non-anatomical shape of the sole unit or insole positioned in contact with it, hence penalizing the user during use. To this can be added the fact that a rubber sole absorbs moisture during use and, in particular, retains soil on muddy ground, leading to a further footwear weight increase with obvious consequences for the user.

SUMMARY OF THE INVENTION

An object of the present invention is to provide footwear, in particular sports footwear, which is lightweight, returns energy to the user's foot on being lifted after contact with the ground, absorbs little or no moisture, and adequately supports the user's foot.

A further object of the invention is to provide footwear of the aforesaid type the use of which cannot excessively tire the user and which cannot in any way damage his bone and muscular structure.

These and further objects which will be apparent to the expert of the art are attained by footwear, in particular sports footwear, in accordance with the accompanying claims.

BRIEF DESCRIPTION OF THE DRAWINGS

The present invention will be more apparent from the accompanying drawing, which is provided by way of non-limiting example which.

DESCRIPTION OF THE PREFERRED EMBODIMENTS

Figure 1:
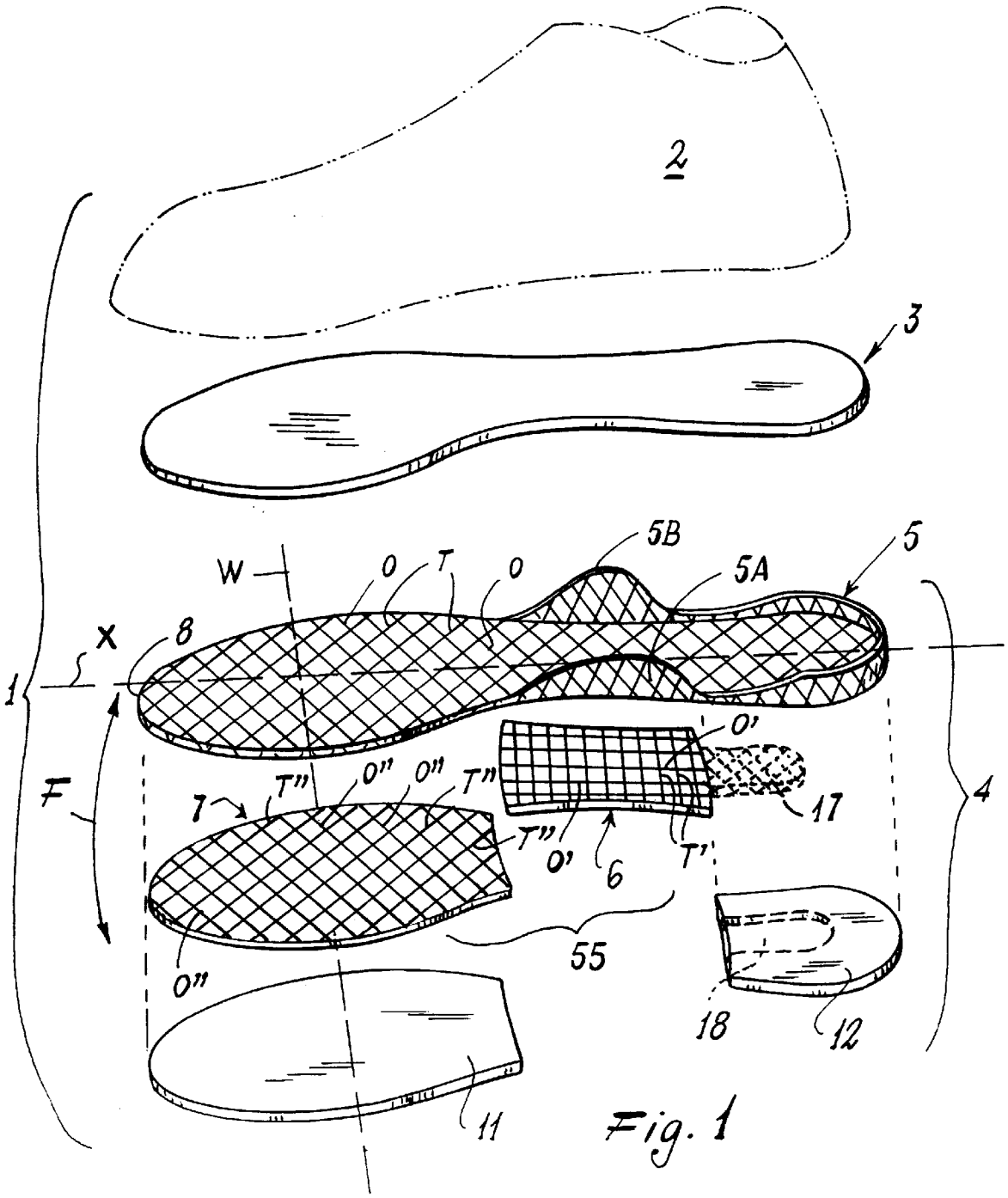
FIG. 1 is an exploded view of footwear according to a first embodiment the invention.
Figure 2:
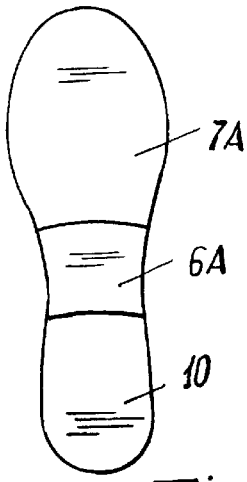
FIG. 2 is a view of the footwear of FIG. 1 as viewed from below.
Figure 3:
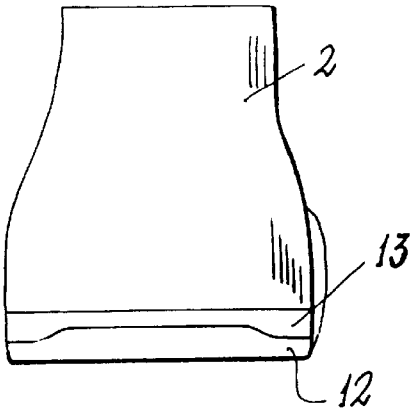
FIG. 3 is a rear view of the footwear of FIG. 1 from the rear.

With reference to FIGS. 1, 2 and 3, footwear 1, in particular sports footwear, comprises a vamp 2, an insole 3 and a sole unit 4. The latter comprises a first portion 5 or sole piece of composite woven material (i.e., comprising weft fibers T and warp fibers 0 bound together as in a usual fabric). These fibers can be carbon fibers impregnated with a thermosetting resin (or carbo-resin) and/or fibers of a material known by the commercial name of Kevlar (aramid fibers impregnated with a thermosetting resin). If carbon fibers are combined with aramid fibers, a fabric is obtained in which for example the weft is of carbon fibers and the warp is of aramid or Kevlar fibers). Said weft fibers T (or warp fibers 0) are all parallel to each other, all lying at a predetermined angle to a longitudinal axis X of the shoes (the weft fibers, however, being perpendicular to the warp fibers).

With the first portion 5 there is associated a second portion of woven composite material 6 positioned to correspond with the plantar arch of the user and a third portion of woven composite material 7 positioned to correspond with the metatarsal region of the user (which, as in the embodiment shown on the figures, can cover the entire part between the front end 8 of the shoe 1 and the second portion 6). The second portion 6 and third portion 7 define a second sole piece of composite material 55. The first portion comprises lateral flanges 5A and 5B.

More specifically, in the case of FIGS. 1, 2 and 3 in which the sole pieces 5 and 55 are coupled together, the first and second portion 5 and 6 have their fibers (carbon, aramid or the like) arranged mutually crossed to achieve considerable torsional rigidity of the corresponding sole piece. In other words, the weft fibers T and warp fibers 0 in one portion (for example the portion 5) are arranged with different spatial angulation from the weft fibers T' and warp fibers O' of the second portion 6. For example the fibers T are positioned at a 45° angle to the longitudinal axis X of the sole pieces and the fibers T' are positioned at a 90° angle to said axis X. In particular, in the plantar arch region the superposing of the portion 5 on the portion 6 defines a torsionally very rigid assembly. The plantar arch part is also rigid against flexure.

The constituent fibers of the portion 7 (i.e., weft fibers T" and warp fibers 0") are arranged in a single orientation, this orientation being such that all the weft and warp fibers present in this portion are arranged parallel to each other in a predetermined spatial orientation, or all at a predetermined angle to the axis X (such still being arranged at a 90° angle to each other). The fibers T" and O" of the portion 7 are orientated parallel to those fibers T and 0 of the sole pieces 5 which are at least present in that part of the latter which cooperates with the portion 7. The mono-orientated fibers of the portion 7 and of the corresponding sole piece 5 (having the weft fibers T and T" and the warp fibers 0 and 0" parallel to each other) provide flexibility to the sole metatarsal portion (in the direction of the arrow F) even when the portion 7 is associated with the portion 5 to enable this portion to undergo normal bending about an axis W perpendicular to the longitudinal axis X of the footwear and positioned between the end 8 of the footwear 1 and the portion 6.

The portion or sole piece 5 in any event possesses its own limited flexibility due to the particular mono-orientated arrangement of its weft and warp fibers.

With the footwear of the invention, the lower part of the sole unit is divided (see FIG. 2) into three regions, namely the metatarsal region 7A (corresponding to the portion 7), the plantar arch region 6A (corresponding to the portion 6) and the heel region 10. Preferably the metatarsal region 7A and the heel region 10 are covered with a layer of rubber 11, 12 fixed to the portions 5 and 7, for example by an adhesive or similar fixing means.

Preferably, corresponding with the heel region 10, the portion 5 comprises a part 13 which is concave towards the bottom of the shoe (i.e., towards the ground). The concave part 13 acts as a spring element arranged to return to the user part of the energy which he transfers to the ground during his movement. This is achieved without the need to insert into the shoe 1 shown in the FIGS. any additional elastic body (such as those known in the state of the art) acting as an element for returning energy to the user's foot.

During use, the sole unit according to the invention is sufficiently rigid to adequately support the user's foot during his movement. However, as the metatarsal region 7A is sufficiently flexible, the sole unit possesses adequate "yieldability" to the extent of not negatively influencing the bone and muscular structure of the user's foot, thus preventing microfractures which could be extremely dangerous, particularly if the user is an athlete. In addition, the flexibility of the region 7A, covered by the portion 7 extending from the end 8 of the footwear to the region 6A, is such as to enable it to act as an element for returning the maximum possible amount of the energy directed by the user towards the ground during his movement, and to generate a considerable thrust effect (which is very advantageous in sports, for example in athletics and basketball). This effect, when added to that of the part 13, results in a considerable return of energy to the user during his movement.

According to a second embodiment of the invention, shown in FIG. 1, from the portion 6 there extends a projection 17 lying coplanar therewith. The projection 17 (or tongue), preferably being of woven composite material comprising weft and warp fibers orientated in the same manner as those of the portion 5 and parallel to them (i.e., mono-orientated), penetrates into a corresponding seat 18 in the rubber layer 12. This embodiment results in increased stability of the shoe 1 and hence correct support of the user's foot on the ground.

Figure 4:
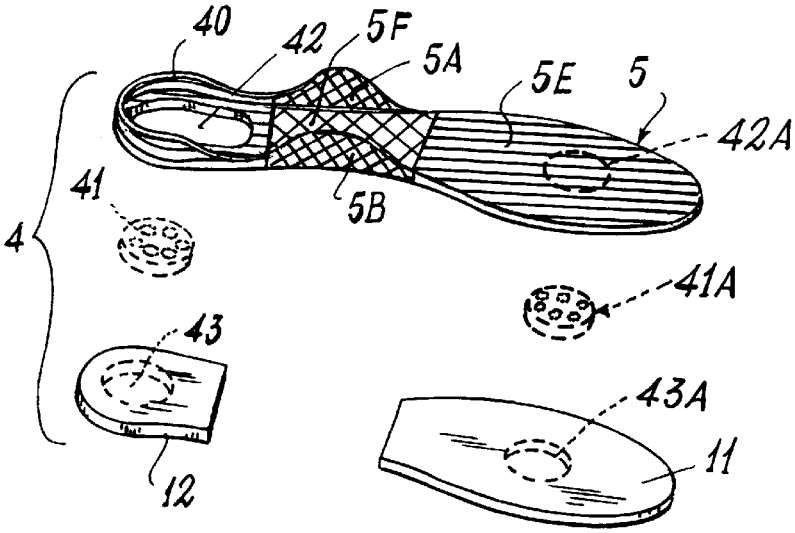
FIG. 4 is an exploded view of a second embodiment modification of the invention.

A second embodiment is shown in FIG. 4, in which parts corresponding to those described are indicated by the same reference numerals. In the embodiment shown in this figure, the portion 5 (represented schematically only by its weft fibers T) is not coupled to any other portion of woven composite material but comprises, in contrast to the corresponding portion 5 of FIG. 1, a mono-layer metatarsal part 5E of mono-orientated fibers (in the aforesaid sense) and a part 5F, corresponding with the plantar arch, comprising at least two superposed layers. Each layer comprises its own weft and warp fibers woven in the usual manner. The weft (and warp) fibers of the two layers are: however, at a different angle to the axis X so as to define overall a portion 5F consisting of crossed fibers. In correspondence with the user's heel or the region 10 of the sole unit, the portion or sole piece 5 comprises a single layer of woven fibers of composite material such as that of metatarsal part 5E and comprises an annular rim 40 (as flexible as the part 5E) which extends along the perimeter edge of said region. In this manner the region 10 can also house an elastic insert 41 able to restore to the user a part of the energy which he transfers to the ground during his movement. This insert is of known type (for example as described in U.S. Pat. No. 5,369,896 or U.S. Pat. No. 5,092,060) the disclosure of which is incorporated by reference and will not be further described. In particular, the insert 41 can be housed in a seat 42 provided in the portion 5 (bounded by the rim 40) and/or in a seat 43 provided in the rubber layer 12 associated with the portion 5 in the heel region 10. If required, a further insert 41A can be inserted into a seat 42A provided in a metatarsal region of the portion or sole piece 5 and/or in a seat 43A provided in the layer 12. The insert 41A has the identical or equivalent characteristics of the insert 41.

The embodiment of FIG. 4 results in increased stability of the shoe 1 and hence correct support of the user's foot on the ground. In this respect, the sole piece 5 is torsionally rigid in the region 6A of the sole unit and flexible in the region 7A about the axis W.

Figure 5:
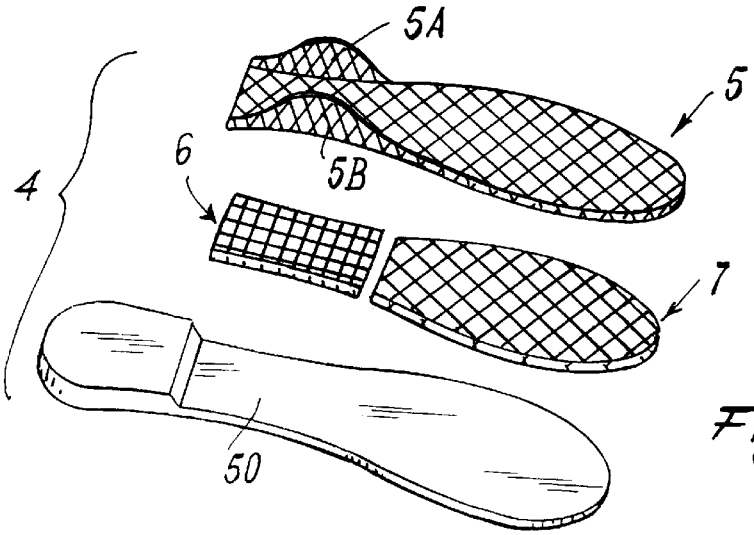
FIG. 5 is an exploded view of a third embodiment of the invention.

In the modification of FIG. 5, in which parts corresponding to those of the already described in the figures are indicated by the same reference numerals, the portion 5 (analogous to that of FIG. 1) only involves the regions 6A and 7A of the sole unit, no composite material layer (comprising carbon, aramid or other fibers) being present in the heel region 10. In this modification, the sole unit also comprises a lower rubber part 50 involving the entire sole unit 4. This embodiment results in lower production costs for the footwear 1.

In a further very exemplified embodiment, the sole unit 4 can also comprise just the portions 6 and 7 associated directly with the insole 3 (and hence not comprising the portion 5 as in FIGS. 1 and 5), the portion 6 comprising two layers of fabric, the weft and warp of one layer being of different spatial inclination to the axis X than the weft and warp of the other layer.

Various modifications of the invention have been described. All comprise a sole unit 4 consisting at least of: a plantar arch region 6A comprising at least two superposed portions of textile fibers of composite material (of carbon, aramid, carbon-aramid combination, or the like), the weft and warp fibers of a first portion having a first inclination to the footwear longitudinal axis and the weft and warp fibers of the second portion having a different inclination to said axis, said fibers of the first and second portion hence being crossed; and a metatarsal region 7A (i.e. that sole region between the region 6A and its end 8) defined by a portion 7 or part 5E of woven composite material having its weft and warp fibers all with equal inclination to the footwear longitudinal axis, said fibers hence being mono-orientated. The reason for this is to achieve a sole unit which is rigid in correspondence with the plantar arch and flexible towards the front, while maintaining the necessary torsional rigidity. With said portions there can be associated a further sole piece 5 of composite material woven with weft and warp fibers arranged at different inclinations from the corresponding ones of the portion 6 positioned within the plantar arch 6A but with identical inclination to those of the portion present within the metatarsal region 7A.

In a further embodiment of the invention, instead of the portions 5, 6 and 7 or 6 and 7 or merely portion 5 (as in FIG. 4) being constructed of composite materials comprising fibrous components, the portions 5, 6 and portions 7 or 6 and 7 or merely 5 are constructed of composite materials sintered in accordance with the known art. In particular, in this further embodiment, the non-flexible and torsionally rigid region (such as 6A) is obtained by sintering procedures comprising at least one stage of pressing carbon, aramid or similar powder associated with the relative resin, at a particular pressure different from the pressure to which the powder is subjected for defining the region 7A, which is flexible about the aforeindicated axis W. The reason for this is to achieve the desired flexibility of this latter layer.

Alternatively, the different behavior (flexible or rigid) of the different sole pieces or portions of woven composite material is obtained by making these latter of different thicknesses depending on their different mechanical behavior. This ensures the required flexibility of the metatarsal region 7A of the sole unit and the rigidity of the arch region 6A.

If the portions or layers 5, 6 and 7 are obtained as in the accompanying FIGS., the footwear can be constructed by the following steps: the vamp is drawn over a last having the shape of a foot of an average user or of a particular athlete (or generic user) for whom the shoe is produced. A layer of known porous material (known as EVA or ethyl vinyl acetate) or of polyurethane or low-density rubber is arranged on the sole portion of this last to define the insole 3, after which one or more previously formed sole pieces of composite material are associated with this layer. Each of these sole pieces is formed by placing the already woven composite material impregnated with resin, for example an epoxy resin, on a foot cast having the negative shape of the sole of said foot. In this manner a sole preform is obtained, to be cut according to the dimensions of said foot.

Preferably after constructing said preform, on at least one of its opposing faces (that to be fixed to the rubber layer of the sole unit) there is applied a fabric impregnated with the same resin with which the composite material is impregnated. By virtue of its nature, this fabric has substantial surface roughness.

The preform obtained in this manner, still associated with the last, is then placed in an enclosure to which vacuum is applied. This enclosure together with its contents is placed in an environment at high pressure, much higher than atmospheric (for example between 8 and 15 bar). With these operations, initially (by means of the vacuum) the layer of composite material assumes the shape of the sole of the foot and then (by means of the pressure) the fibers of this layer are highly compacted by the expulsion from this latter of the excess resin present between and on said fibers. This latter operation gives flexibility to the composite material layer for example about an axis perpendicular to the longitudinal axis of the sole.

The sole piece shaped in this manner (and removed from its enclosure) is now dried at a relatively high temperature (exceeding 100°–120° C.) in an environment of relatively high pressure (5–7 bar) for a relatively long time (between 8 and 14 hours). The choice of said drying temperature, the pressure at which it occurs, together with said time, is made on the basis of the composite material used and the thickness of the sole piece.

After this treatment, the sole piece is cleaned of any burrs and the fabric associated with its faces is separated therefrom. Because of the roughness of this fabric, small impressions remain on said faces, allowing better fixing by the glue used for securing the sole piece to the other parts of the shoe (rubber parts and vamp). The sole piece is then secured to these parts by gluing.

It has been surprisingly found that the use of biadhesive tapes for this securing to said shoe parts achieves a more uniform distribution of the adhesive material between the contacting parts, thus improving their bond.

The sole piece obtained in this manner is anatomical and hence has the shape of the user's foot.

Finally, when securing the sole piece (or sole pieces 5 and 55) to the other parts of the shoe, elastic inserts for returning to his foot the energy transferred by the user to the ground during his movement can be positioned in the sole piece.

Because of the particular method used to secure the composite material portions 5 (or 6 and 7) to the insole 3, this material becomes shaped in accordance with the sole of a (particular or average) user's foot. The anatomical shape of the portion or sole piece 5 (or layers 6 and 7 if this portion is not present) results in improved comfort of the shoe (containing one or more additional insoles positioned between the insole 3 and the user's foot), which is safer for the user to the extent of preventing the ever possible small injuries to his foot musculature caused by a particular sporting activity or a particularly prolonged use of the footwear.

The footwear 1 according to the invention is lightweight and does not tire the user. In addition, it results in an optimum return to the user of the energy transferred by him to the ground during his movement. This is achieved even without the further insertion of elastic elements (suitable for this purpose) into the sole unit 4.

Additionally, the usual segments, cleats or studs used by particular athletes, such as soccer players or sprinters, can be simply glued to the individual composite material layers of the shoe 1, without this gluing operation (executed for example with epoxy resins) resulting in detachment of said segments or studs with time. Hence the complex molding operations used for associating said segments or studs with sports footwear provided with a sole unit of rubber or a similar material are no longer necessary.

In addition, the rubber layer (or layers) associated with each portion of composite material (of woven fibers or sintered material) can be considerably reduced as compared with known arrangements, resulting in a reduction in moisture (and possibly soiling) absorption from the ground on which the user moves (such moisture not being absorbed by any composite material layer). This results in a considerable reduction in the weight increase of the footwear during its use. Various embodiments of the invention have been described. Others, in the form of sports or walking shoes, can however be provided (such as one in which the layers 5, 6 and 7 are partly sintered and partly of fiber-based composite material). In particular, sole units can be formed with composite material inserts of different shapes for the different sports for which the footwear 1 is used. For example, the portion 7 may only partly involve the region 7A of the sole unit. In a first embodiment this portion is shaped with a central recess and lateral flanges which extend in proximity to the edges of the sole unit as far as the end 8 of the footwear. In a second embodiment, these flanges extend only slightly beyond the axis W of the region 7A. These different embodiments are chosen on the basis of the speed which the athlete wishes to achieve and hence on the basis of the sport which he practices.

Likewise the portion 6 can be flat (for example for an athletic contest and for use as a marathon shoe), can be arch shaped (for example for training), or can comprise lateral reinforcements which follow, and are superposed to a greater or lesser extent on, the flanges 5A and 5B of the portion 5 (enabling the antitwisting effect of the shoe to be modified).

Finally, in the region 10 the portion 5 (or the possible projection 17) can be substantially of dovetail shape to achieve an anti-pronation effect and improve the shoe damping and stabilization.

These modifications (or combinations thereof) are to be considered as falling within the scope of the present invention.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. Footwear, in particular sports footwear, comprising:

a vamp which is connectable with a sole unit supporting the foot of the wearer, the sole unit comprising at least one sole piece formed of a composite material, said sole piece including a rigid first portion positioned corresponding with a plantar arch region of the sole unit, and a flexible second portion positioned between a front end of the footwear and the plantar arch region, said second portion being flexible about at least one axis positioned between said front end and the plantar arch region of the footwear wherein the composite material comprises woven fibers which are crossed with one another, the fibers of the rigid first portion are crossed with one another and the flexible second portion comprises first and second crossed fibers, said first fibers being oriented in a single direction.

2. Footwear as claimed in claim 1, wherein the sole pieces of woven composite material are anatomically shaped.

3. Footwear as claimed in claim 1, wherein the woven fibers comprise carbon fibers or aramid fibers.

4. Footwear as claimed in claim 1, wherein the composite material comprises carbon fibers and aramid fibers woven together to define a fabric.

5. Footwear as claimed in claim 1, wherein the rigid first portion of the sole unit comprises at least first and second layers of woven composite material, said first layer comprising weft and warp fibers lying spatially at a first angle with respect to a longitudinal axis of the footwear, the second layer having weft and warp fibers lying spatially at a second angle with respect to said axis, which is different from that of the corresponding fibers of the first layer, and wherein said fibers of said first layer cross said second layer.

6. Footwear as claimed in claim 1, wherein the flexible second portion of the sole unit comprises at least one layer of woven composite material having weft and warp fibers which lay spatially in layers at equal angles with respect to the footwear longitudinal axis or are mono-orientated.

7. Footwear as claimed in claim 6, wherein the flexible second portion of the sole unit comprises a plurality of superposed layers of woven composite material wherein each of the layers have weft and warp fibers lying spatially in layers.

8. Footwear as claimed in claim 1, wherein the sole unit comprises a third portion of woven composite material supporting the first and second portions and arranged at least corresponding with a metatarsal region and a plantar arch of the sole, said third portion having weft and warp fibers lying spatially in a manner corresponding to that of the fibers of the second portion, said fibers of said third portion lying spatially in a different manner than that of the corresponding fibers of the first portion, which are crossed by the fibers of said third portion.

9. Footwear as claimed in claim 8, wherein the third portion is located in each of said planter arch region, said metatarsal region and a heel region of the sole unit.

10. Footwear as claimed in claim 8, wherein the third portion is located only in a heel region of the sole unit.

11. Footwear as claimed in claim 1, wherein corresponding with a heel region of the sole unit a flexible annular part of woven composite material is provided so as to extend from the first rigid portion positioned in correspondence with the plantar arch.

12. Footwear as claimed in claim 11, wherein the annular part has a cavity formed therein and an elastic insert is positioned in the cavity and is arranged to return to the user part of the energy transferred by the user to the ground during movement of the user.

13. Footwear as claimed in claim 1, wherein the second portion comprises a seat and an elastic insert positioned in said seat, said insert returning to a user part of the energy transferred by the user to the ground during movement of the user.

14. Footwear as claimed in claim 8, wherein the third portion comprises a part, positioned corresponding with a heel of the user, having ground-facing concavity.

15. Footwear as claimed in claim 1, wherein at least part at least one of said first and said second portions is covered with a layer of rubber.

16. Footwear as claimed in claim 15, wherein at least part of the first and second portion has a rough surface permitting fixing of a gluing element securing thereto said rubber layer.

17. Footwear as claimed in claim 1, wherein said first rigid portion has a projection extending therefrom and a rubber part positioned corresponding with a heel region of the sole unit and said rubber part comprises a seat accommodating said projection and wherein said projection comprises a woven composite material with mono-orientated fibers.

18. Footwear as claimed in claim 1, wherein a rubber part is positioned corresponding with a heel region of the sole unit, said rubber part comprising a seat into which an insert is inserted to restore to a user part of the energy transferred by the user to the ground during movement of the user.

19. Footwear as claimed in claim 1, wherein the flexible second portion has one of segments, cleats and studs glued to said second portion.

20. Footwear as claimed in claim 1, wherein the composite material comprises a sintered material.

21. Footwear as claimed in claim 16, wherein the first portion comprises a sintered composite material and has a greater thickness than that of the flexible second portion.

* * * * *